US010273070B2

(12) United States Patent
Perkins et al.

(10) Patent No.: US 10,273,070 B2
(45) Date of Patent: Apr. 30, 2019

(54) COLLAPSIBLE CONTAINER

(71) Applicants: David W. Perkins, Cedar Rapids, IA (US); William L. Chase, Des Moines, IA (US)

(72) Inventors: David W. Perkins, Cedar Rapids, IA (US); William L. Chase, Des Moines, IA (US)

(73) Assignee: Paper Systems, Inc., Des Moines, IA (US)

( * ) Notice: Subject to any disclaimer, the term of this patent is extended or adjusted under 35 U.S.C. 154(b) by 160 days.

(21) Appl. No.: 15/600,236

(22) Filed: May 19, 2017

(65) Prior Publication Data

US 2018/0334305 A1 Nov. 22, 2018

(51) Int. Cl.
*B65D 77/06* (2006.01)

(52) U.S. Cl.
CPC ..... *B65D 77/061* (2013.01); *B65D 77/065* (2013.01)

(58) Field of Classification Search
CPC ..... B65D 5/00; B65D 39/00; B65D 39/0005; B65D 2519/00303; B65D 2519/00318; B65D 2519/00288; B65D 2519/00497; B65D 2519/00507
USPC ..... 229/117.35
See application file for complete search history.

(56) References Cited

U.S. PATENT DOCUMENTS

| | | | |
|---|---|---|---|
| 186,459 | A | 1/1877 | Buckingham |
| 371,159 | A | 10/1887 | Wright, Jr. |
| 648,385 | A | 5/1900 | Burns |
| 896,600 | A | 8/1908 | Thornton |
| 942,733 | A | 12/1909 | Moses |
| 1,161,336 | A | 11/1915 | Potucek |
| 1,401,549 | A | 12/1921 | Nordstrom |
| 1,507,977 | A | 9/1924 | Schaefer |
| 1,585,390 | A | 5/1926 | Kondolf |
| 1,758,230 | A | 5/1930 | Lange |
| 1,926,432 | A | 9/1933 | Butts et al. |
| 2,147,563 | A | 2/1939 | Turner |
| 2,226,050 | A | 12/1940 | Chambliss |
| 2,246,097 | A | 6/1941 | Abraham |
| 2,279,233 | A | 4/1942 | Groves |

(Continued)

FOREIGN PATENT DOCUMENTS

| | | |
|---|---|---|
| EP | 0149889 | 7/1985 |
| EP | 0589483 | 3/1993 |

(Continued)

OTHER PUBLICATIONS

US 6,675,964 B1, 01/2004, Beck (withdrawn)

*Primary Examiner* — Brian D Nash
(74) *Attorney, Agent, or Firm* — Brett J. Trout

(57) ABSTRACT

A collapsible container for the storage and transport of flowable material. The container is provided with a continuous sheet of side panels secured into stepped engagement with itself to define an interior. Foldable support brackets are secured to the side panels to maintain the side panels at an angled orientation relative to the side panels of the container and to prevent distortion of the side panels by hydrostatic pressure toward a circular orientation. The support brackets define an opening in the top of the collapsible container through which a fill head may engage a top cap of a flexible liner provided within the collapsible container, to fill the liner with flowable material.

17 Claims, 7 Drawing Sheets

(56) References Cited

U.S. PATENT DOCUMENTS 2,345,000 A 3/1944 Newsom
2,382,536 A 8/1945 Baxter
2,422,239 A 6/1947 Holt
2,522,597 A 9/1950 Blandford
2,562,261 A 7/1951 Collins
2,565,053 A 8/1951 Stenger
2,609,136 A 9/1952 Sider
2,617,579 A 11/1952 Buttery
2,619,276 A 11/1952 Gibbons
2,688,431 A 9/1954 Loeb et al.
2,799,440 A 7/1957 Frederich
2,869,750 A 1/1959 Doerr et al.
2,887,264 A 5/1959 Fallert
2,949,151 A 8/1960 Goldstein
3,007,622 A 11/1961 George
3,045,387 A 7/1962 Simpson
3,094,361 A 6/1963 Poyer
3,132,791 A 5/1964 Haysler et al.
3,157,345 A 11/1964 George
3,206,099 A 9/1965 Fanter et al.
3,219,255 A 11/1965 Holmes
3,302,909 A 2/1967 Glassman
3,303,965 A 2/1967 Parker et al.
3,337,112 A 8/1967 Thurston
3,372,725 A 3/1968 Voorhees
3,374,915 A 3/1968 Verhein et al.
3,401,814 A 9/1968 Chiswell et al.
3,409,169 A 11/1968 Levenhagen
3,410,328 A 11/1968 Sasai
3,489,314 A 1/1970 Slapnik
3,515,864 A 6/1970 Levy
3,521,764 A 7/1970 Loomis
3,701,466 A 10/1972 Woodrow et al.
3,762,343 A 10/1973 Thacker
3,770,187 A 11/1973 Faires et al.
3,822,806 A 7/1974 Grimes
3,883,065 A 5/1975 Presnick
3,910,482 A 10/1975 Bamburg
3,932,946 A 1/1976 Johnson
3,936,334 A 2/1976 Kushida et al.
3,949,874 A 4/1976 Heavner
4,014,496 A 3/1977 Christensson
4,036,361 A 7/1977 Jacobson
4,056,223 A 11/1977 Williams
4,082,215 A 4/1978 Eichenauer
4,087,041 A 5/1978 Centanni
4,138,054 A 2/1979 Spencer
4,159,096 A 6/1979 Chase
4,186,841 A 2/1980 Buckley et al.
4,216,897 A 8/1980 Collura et al.
4,226,327 A 10/1980 Ballard
4,266,670 A 5/1981 Mykleby
4,266,678 A 5/1981 Daly
4,287,997 A 9/1981 Rolfe et al.
4,296,860 A * 10/1981 Hsu ..... B65D 5/12 206/386
4,339,047 A 7/1982 Johansson
4,358,049 A 11/1982 Kupersmit
4,359,182 A 11/1982 Perkins
4,369,914 A 1/1983 Langston, Jr.
4,380,314 A 4/1983 Langston, Jr.
4,383,609 A 5/1983 Lochmiller
4,392,606 A 7/1983 Fremion
4,392,607 A 7/1983 Perkins, Jr.
4,411,373 A 10/1983 Kupersmit
4,421,253 A 12/1983 Croley
4,519,893 A 5/1985 Olas
4,548,351 A 10/1985 Gusic
4,549,673 A * 10/1985 Kupersmit ..... B67D 3/04 206/599
4,571,881 A 2/1986 Lathim
4,585,143 A 4/1986 Fremow et al.
4,591,065 A 5/1986 Foy
4,595,137 A 6/1986 Kupersmit
4,596,355 A 6/1986 Kupersmit
4,601,407 A 7/1986 Gillard
4,606,461 A 8/1986 Bolton, Sr.
4,673,087 A 6/1987 Webb
4,678,089 A 7/1987 Lang
4,691,859 A 9/1987 Snyder
4,693,411 A 9/1987 Snyder
4,693,413 A 9/1987 McFarland et al.
4,702,408 A 10/1987 Powlenko
4,708,260 A 11/1987 Siegal et al.
4,729,505 A 3/1988 Remaks et al.
4,742,951 A 5/1988 Kelly et al.
4,749,083 A 6/1988 Growney
4,762,270 A 8/1988 Stoll
4,771,917 A 9/1988 Heaps et al.
4,786,192 A 11/1988 Graves et al.
4,792,084 A * 12/1988 Dreeszen ..... B65D 5/2033 229/109
4,796,788 A 1/1989 Bond
4,804,087 A 2/1989 Smith
4,809,851 A 3/1989 Destreich et al.
4,815,631 A 3/1989 Eeg et al.
4,817,824 A 4/1989 LaFleur et al.
4,850,506 A 7/1989 Heaps et al.
4,880,141 A 11/1989 Gossler et al.
RE33,128 E 12/1989 Nordstrom
4,900,163 A 2/1990 Mack
4,934,636 A 6/1990 Orlosky et al.
4,949,898 A 8/1990 Nederveld
4,976,411 A 12/1990 Gordon et al.
5,025,925 A 6/1991 Wiklund
5,056,667 A 10/1991 Coogan
5,069,359 A 12/1991 Liebel
5,090,614 A 2/1992 Kupersmit
5,096,092 A 3/1992 Devine
5,123,541 A 6/1992 Giannini et al.
5,139,196 A 8/1992 Fry et al.
5,145,110 A 9/1992 Terpstra
5,157,900 A 10/1992 Kupersmit
5,215,248 A 6/1993 Moser
5,228,589 A 7/1993 Della Riva
5,236,099 A 8/1993 Fties et al.
5,269,455 A 12/1993 Grigsby
5,279,423 A 1/1994 Shuert
5,289,937 A 3/1994 Boots
5,301,872 A 4/1994 Tusing
5,305,875 A 4/1994 Meyer
5,305,950 A 4/1994 Oppenheim
5,318,219 A 6/1994 Smith
5,351,847 A 10/1994 Greenbaum
5,353,982 A 10/1994 Perkins et al.
5,356,029 A * 10/1994 Hogan ..... B65D 77/061 222/105
5,402,906 A 4/1995 Brown et al.
5,437,384 A 8/1995 Farrell
5,474,230 A 12/1995 Yotukura
5,497,972 A 3/1996 Sofy
5,501,333 A 3/1996 Swan
5,501,395 A 3/1996 McElroy
5,549,341 A 8/1996 Chase et al.
5,573,175 A 11/1996 Straub et al.
5,586,717 A 12/1996 Hallam
5,588,372 A 12/1996 Lelly
5,660,291 A 8/1997 Dash
5,671,858 A 9/1997 Hsu
5,687,902 A 11/1997 Tusing
5,722,552 A 3/1998 Olson
5,735,423 A 4/1998 Black
5,746,343 A 5/1998 Waltke et al.
5,749,489 A 5/1998 Benner
5,758,856 A 6/1998 Carnahan et al.
5,788,121 A * 8/1998 Sasaki ..... B65D 77/065 222/105
5,803,346 A 9/1998 Baker et al.
5,813,562 A * 9/1998 Perkins ..... B65D 77/061 220/495.05
5,897,211 A 4/1999 Hafer et al.
5,934,474 A 8/1999 Renninger et al.
5,941,452 A 8/1999 Williams et al.
5,943,836 A 8/1999 Kassardjian

(56) References Cited

U.S. PATENT DOCUMENTS

| | | | | |
|---|---|---|---|---|
| 5,944,252 | A | 8/1999 | Connelly et al. | |
| 5,975,303 | A | 11/1999 | Morell | |
| 6,000,549 | A | 12/1999 | Perkins | |
| 6,029,884 | A | 2/2000 | Roeland | |
| 6,050,410 | A | 4/2000 | Quirion | |
| 6,074,331 | A | 6/2000 | Ruggiere, Sr. et al. | |
| 6,094,859 | A | 8/2000 | Kalman et al. | |
| 6,112,928 | A | 9/2000 | Black | |
| 6,113,270 | A | 9/2000 | Hafer | |
| 6,120,181 | A | 9/2000 | Wilcox | |
| 6,161,715 | A | 12/2000 | Stolzman | |
| 6,164,453 | A | 12/2000 | Perkins | |
| 6,168,074 | B1 * | 1/2001 | Petriekis | B65D 5/323 229/122.24 |
| 6,170,689 | B1 | 1/2001 | Flesher | |
| 6,234,351 | B1 | 5/2001 | Wilcox | |
| 6,257,539 | B1 | 7/2001 | Pelaez | |
| 6,286,804 | B1 | 9/2001 | Avinger et al. | |
| 6,296,138 | B1 | 10/2001 | Hannah | |
| 6,378,733 | B1 | 4/2002 | Boonzaler | |
| 6,431,435 | B1 | 8/2002 | Jones et al. | |
| 6,467,652 | B2 | 10/2002 | Wilcox | |
| 6,516,965 | B1 | 2/2003 | Perkins | |
| 6,561,413 | B2 | 5/2003 | Perkins | |
| 6,575,629 | B1 | 6/2003 | Perkins | |
| 6,592,094 | B1 | 7/2003 | Kao | |
| 6,627,873 | B2 | 9/2003 | Tchakarov et al. | |
| 6,631,821 | B2 | 10/2003 | Vourganas | |
| 6,834,792 | B1 | 12/2004 | Perkins | |
| 7,044,427 | B2 | 5/2006 | Eckenswiller | |
| 7,055,807 | B2 | 6/2006 | Pesta | |
| 7,111,815 | B2 | 9/2006 | Mettler et al. | |
| 7,172,108 | B2 | 2/2007 | Ingalls | |
| 7,328,833 | B1 * | 2/2008 | Wiley | B65D 5/32 229/108.1 |
| 7,398,913 | B2 * | 7/2008 | McClure | B65D 5/029 220/495.08 |
| 7,484,623 | B2 | 2/2009 | Goodrich | |
| 7,604,156 | B2 | 10/2009 | Clohessy | |
| 7,607,564 | B2 | 10/2009 | Churvis | |
| 7,628,310 | B2 | 12/2009 | Perkins | |
| 7,654,440 | B2 * | 2/2010 | Quaintance | B65D 5/029 229/109 |
| 7,819,269 | B2 | 10/2010 | Perkins | |
| 7,837,089 | B2 * | 11/2010 | Pacheco | B65D 5/5045 229/122.23 |
| 7,954,670 | B2 | 6/2011 | Stuart | |
| 8,006,855 | B2 | 8/2011 | Lapoint, III | |
| 3,016,145 | A1 | 9/2011 | Perkins | |
| 8,016,113 | B2 | 9/2011 | Perkins | |
| 8,092,360 | B2 * | 1/2012 | Greenfield | B65D 5/0281 493/162 |
| 8,348,087 | B2 | 1/2013 | Sawaki | |
| 8,690,048 | B2 * | 4/2014 | Philips | B65D 5/566 220/23.91 |
| 8,746,541 | B2 * | 6/2014 | Spivey, Sr. | B65D 5/4208 222/185.1 |
| 8,844,797 | B2 * | 9/2014 | Smith | B65D 5/0227 229/109 |
| 9,302,806 | B2 | 4/2016 | Perkins | |
| 2001/0027992 | A1 | 10/2001 | Strong | |
| 2002/0121521 | A1 | 9/2002 | Beal | |
| 2002/0158114 | A1 | 10/2002 | Evans et al. | |
| 2003/0132275 | A1 | 7/2003 | Ingalls | |
| 2004/0026296 | A1 | 2/2004 | Nesting | |
| 2005/0121464 | A1 | 6/2005 | Miller | |
| 2005/0127264 | A1 | 6/2005 | Mettler et al. | |
| 2005/0173280 | A1 | 8/2005 | Cornelius | |
| 2006/0119007 | A1 | 6/2006 | Hoogland | |
| 2006/0169757 | A1 | 8/2006 | McDowell | |
| 2007/0267308 | A1 | 11/2007 | Oberliesen | |
| 2008/0135438 | A1 | 6/2008 | Perkins | |
| 2008/0135547 | A1 | 6/2008 | Perkins | |
| 2008/0137997 | A1 | 6/2008 | Perkins | |
| 2012/0024941 | A1 | 2/2012 | Skinner | |
| 2013/0112686 | A1 | 5/2013 | Kwon | |
| 2015/0129649 | A1 | 5/2015 | Perkins | |

FOREIGN PATENT DOCUMENTS

| | | |
|---|---|---|
| EP | 0573230 | 5/1993 |
| EP | 0703158 | 9/1994 |
| GB | 2084540 | 9/1980 |

* cited by examiner

COLLAPSIBLE CONTAINER

TECHNICAL FIELD

The disclosed embodiments relate generally to bulk containers for flowable materials and, in particular, to collapsible bulk containers having a top defining an open fill area.

BACKGROUND OF THE INVENTION

Cylindrical containers, such as drums, do not maximize floor and pallet space for storage and transport. It would be desirable to provide a container in a cube shape to maximize storage of material on the footprint of a standard pallet.

Conventional rigid containers, such as drums, for the storage and transportation of flowable or fluid materials are bulky and heavy even when not in use. It would therefore be desirable to provide a lightweight container constructed of cardboard or the like. One drawback associated with the use of cardboard is the tendency of cardboard to deform from a square or rectangular cross section toward a circular cross section.

It is known to provide reinforcements to prevent such deformation, but such reinforcements can be complex, heavy, and expensive. It is possible to provide a lightweight container with interlocking top and bottom flaps to prevent the container from deforming. Such flaps, however, can require the user to spend costly time tend interlocking the top and bottom flaps when the container is to be used and releasing the top and bottom flaps when the container is to be stored or transported. It would be desirable to provide top and bottom flaps that do not require as much time to interlock and release the top and bottom flaps, which still providing a flat transport orientation and allowing access to interior of the container through the top of the container so that a fill head may be inserted to fill a flexible bag provided within the container.

It would therefore be desirable to provide a lightweight, flexible container that maximizes the surface area of a standard pallet, may be folded flat for storage or transport, does not require as much time to interlock and release the top and bottom flaps, and which prevents the container from deforming while a fluid nozzle is inserted through an opening in the top of the container to fill a flexible bag contained therein with flowable material.

BRIEF DESCRIPTION OF THE DRAWINGS

The present invention will now be described, by way of example, with reference to the accompanying drawings in which.

DETAILED DESCRIPTION OF THE DRAWINGS

Figure 1:
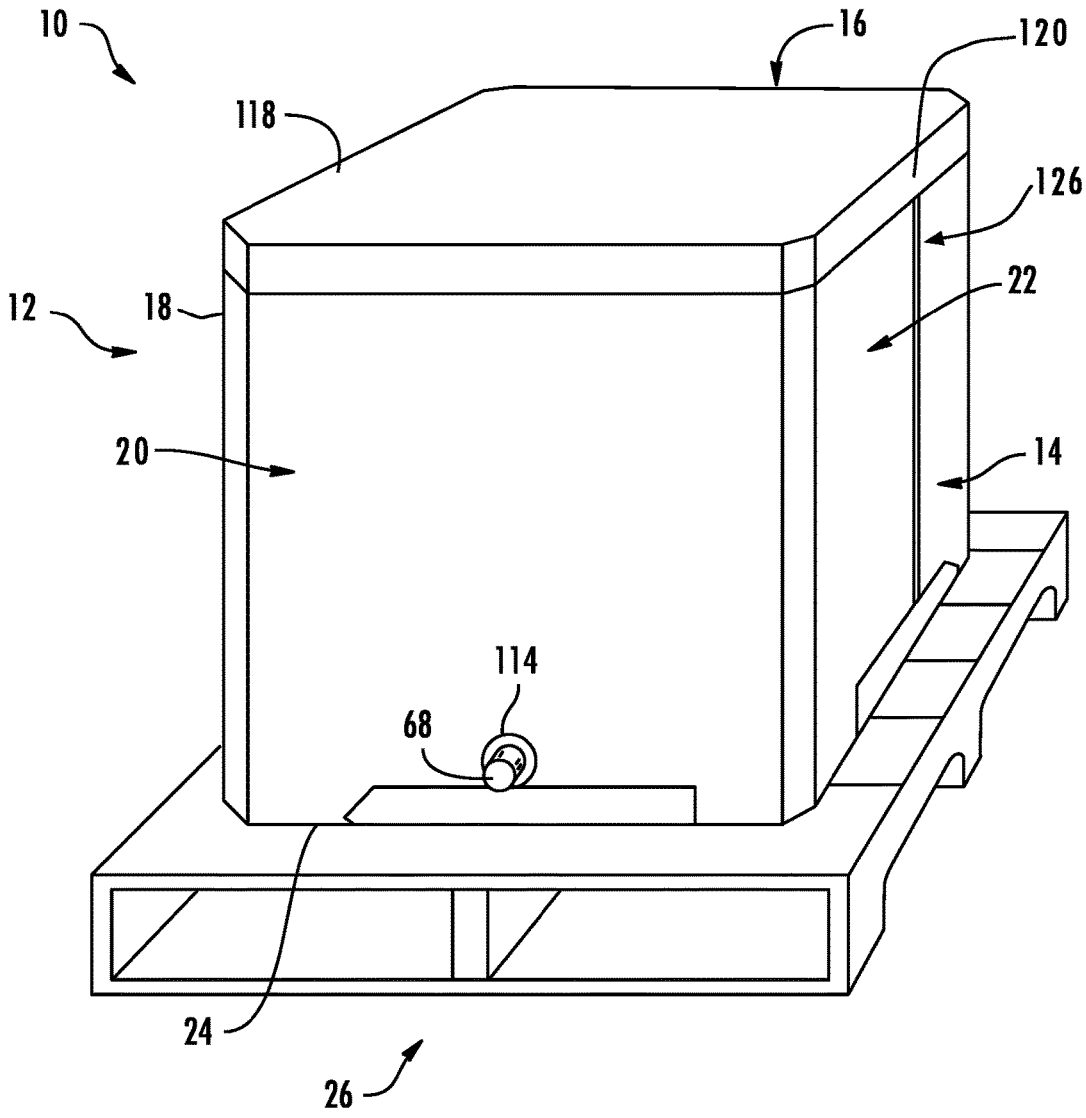
FIG. 1 illustrates a side perspective elevation of a collapsible container in accordance with one embodiment.

A collapsible container for containing flowable materials is shown generally as 10 in FIGS. 1-4. As shown, the container 10 includes a continuous sheet 12 of cardboard defining a first side panel 14, a second side panel 16, a third side panel 18, a fourth side panel 20, and a fifth side panel 22. Although the continuous sheet 12 may be of any suitable dimensions, in a preferred embodiment, the bottom 24 is dimensioned to fit on a standard forty-eight inch long and forty-inch wide stringer pallet 26. Preferably, the continuous sheet 12 is constructed of a first corrugated wall 28 adhesively secured to a second corrugated wall 30 (FIGS. 2-5). The corrugated walls 28 and 30 are preferably constructed of triple wall corrugated cardboard, such as that known in the art.

Figure 2:
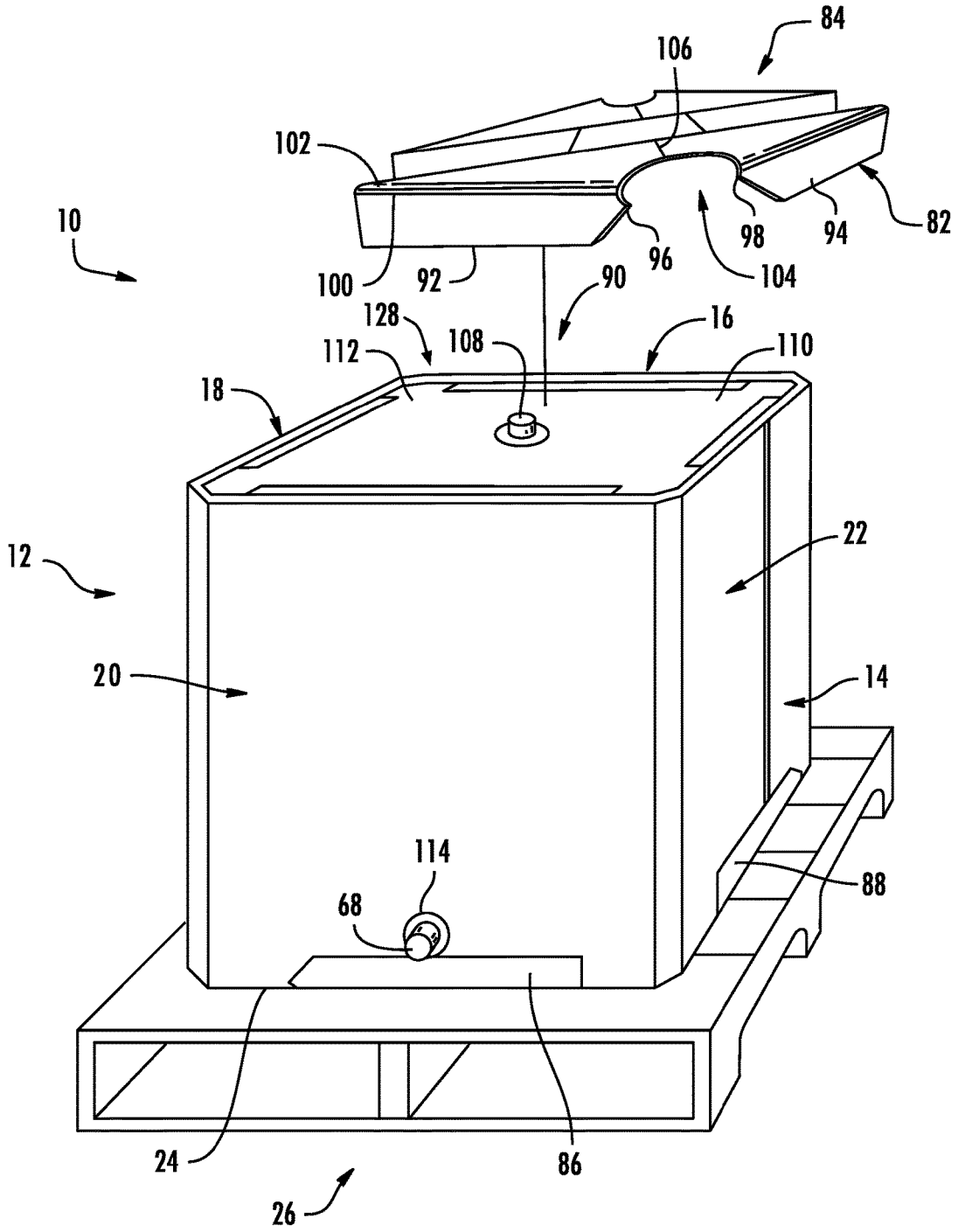
FIG. 2 illustrates a side perspective elevation of the collapsible container of FIG. 1, shown without the lid attached before the top support brackets are attached.
Figure 3:
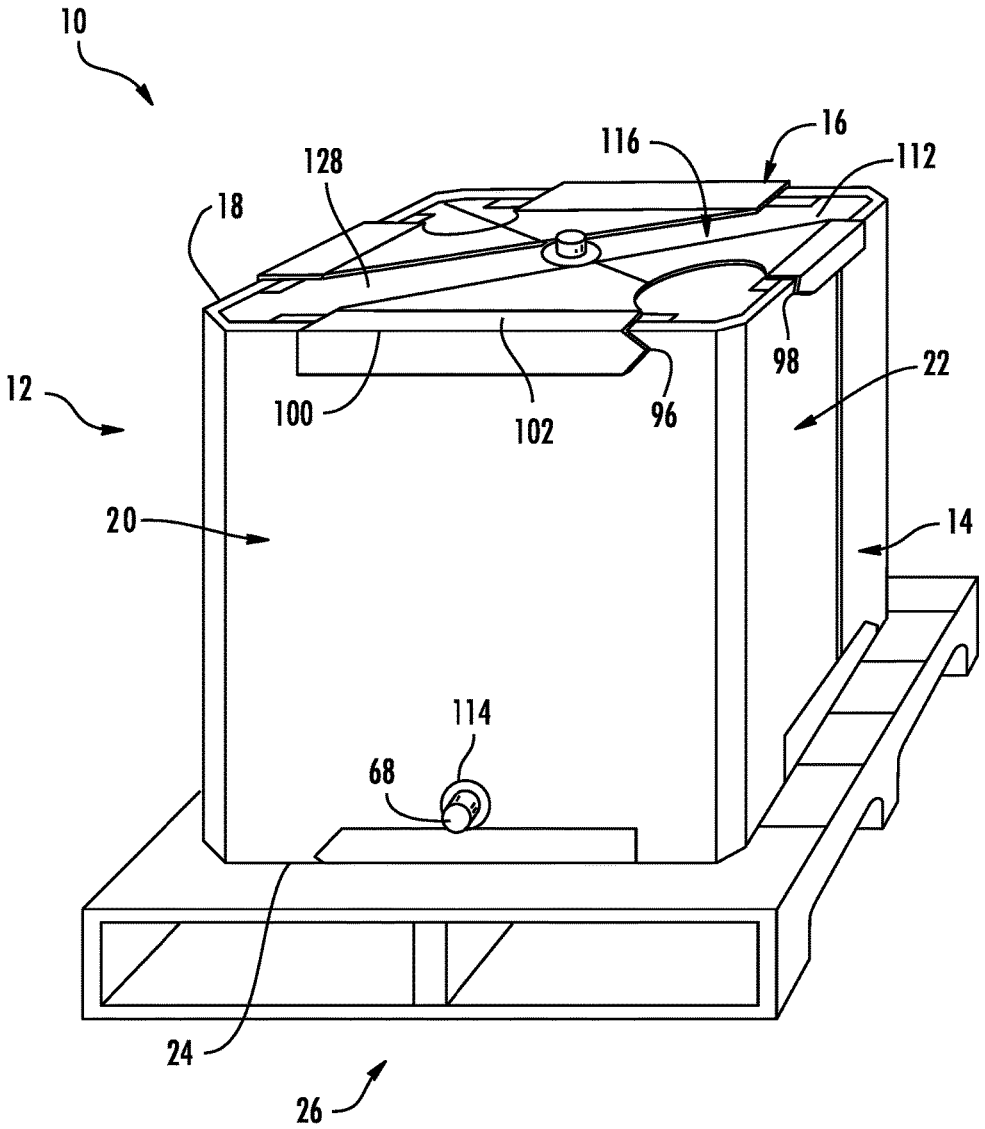
FIG. 3 illustrates a side perspective elevation of the collapsible container of FIG. 1, shown without the lid attached with the top support brackets attached.
Figure 4:
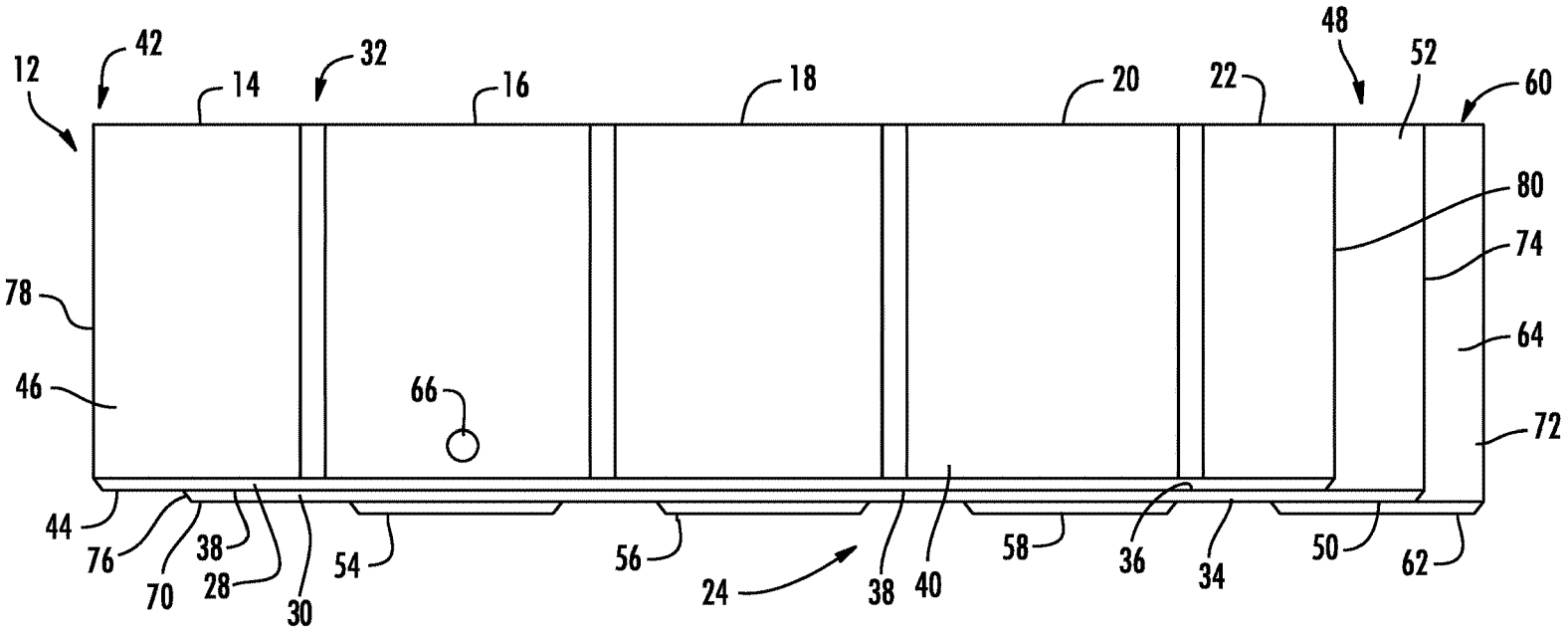
FIG. 4 illustrates a side elevation showing the side panels of the container of FIG. 1 prior to assembly.

As shown in FIG. 4, the continuous sheet 12 is die cut in the configuration shown and provided with a plurality of creases 32 to divide the continuous sheet 12 into the side panels 14-22. The first corrugated wall 28 is provided with an interior side 34 and an exterior side 36 and the second corrugated wall 30 is provided with an interior side 38 and an exterior side 40. The exterior side 36 of the first corrugated wall 28 is secured to the interior side 38 of the second corrugated wall 30 in an offset manner, forming an exposed leading edge 42 on the first side panel 14 having and interior side 44 and an exterior side 46 and an exposed leading edge 48 on the fifth side panel 22 having and interior side 50 and an exterior side 52. The leading edges 42 and 48 are preferably at least two inches wide, more preferably at least three inches wide, and most preferably at least five inches wide. Preferably, the larger the number of corrugated walls 28 and 30 forming the continuous sheet 12, the shorter the leading edges for each respective corrugated wall. For example, it may be desirable to have two leading edges 42 and 48 six inches wide if the corrugated walls 28 and 30 are constructed of triple wall corrugated cardboard, to have four staggered leading edges (two on each side of the continuous sheet as described in the alternative embodiments below), each four inches wide, if the continuous sheet is constructed of three corrugated walls constructed of double wall corrugated cardboard, and to have six staggered leading edges (three on each side of the continuous sheet as described in the alternative embodiments below) each two inches wide if the continuous sheet is constructed of four corrugated walls constructed of single wall corrugated cardboard Also as shown in FIG. 4 are a first connector panel 54 a second connector panel 56, a third connector panel 58, and a fourth connector panel 60 adhesively secured to the second side panel 16, the third side panel 18, the fourth side panel 20, and the fifth side panel 22 respectively. The connector panels 54-60 may be constructed of any suitable material, but are preferably each constructed of two pieces 62 and 64 of single wall corrugated cardboard adhesively secured to one another in a manner such that the corrugations of each of the two pieces 62 and 64 of single wall corrugated cardboard run orthogonal to one another. Any desired number of pieces of cardboard of any number of walls may be used in any desired orientations to construct the connector panels 54-60. The connector panels 54-60 are each secured to the side panels 16, 18, 20, and 22 in a manner such that the corrugations of the piece 62 of the connector panel 54 in direct contact each of side panels 16, 18, 20, and 22 run orthogonal to the corrugations of the side panel 16, 18, 20, or 22 to which it is secured. As shown in FIG. 4, the connector panels 54-60 are preferably the same height as the side panels 16, 18, 20, and 22. The width of the connector panels 54-60 are preferably at least 50% the inside width of the inside panels 16, 18, 20, and 22, more preferably at least 65% the inside width of the inside panels 16, 18, 20, and 22, and most preferably at least 80% the inside width of the inside panels 16, 18, 20, and 22. As shown in FIGS. 2-4, the continuous sheet 12 is also die cut with a circular cutout 66 sized to allow a nozzle 68 to pass through.

Figure 5:
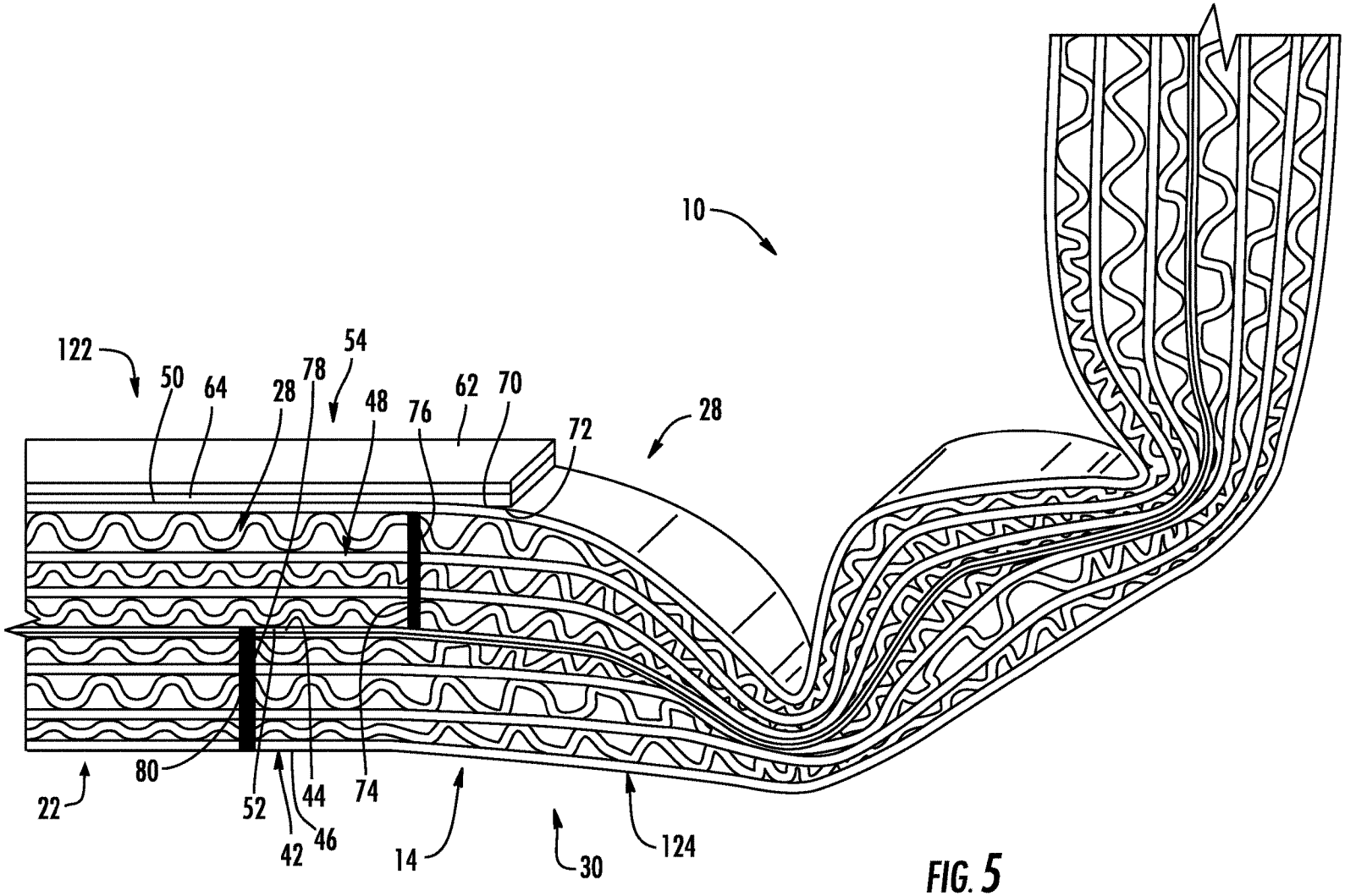
FIG. 5 illustrates a top perspective view of the top of one corner of the container of FIG. 1 before application of the support brackets.

As shown in FIG. 5, to construct the collapsible container 10, the first side panel 14 is adhesively secured to the fifth side panel 22 in a stairstep configuration to form the rectangular collapsible container 10 shown in FIG. 1. The exterior side 52 of the second leading edge 48 is adhesively secured to the interior side 44 of the first leading edge 42, while an interior side 70 of the first side panel 14 is adhesively secured to an exterior side 72 of the fourth connector panel 60.

The butt 74 of the leading edge 48 of the first wall 28 preferably abuts the butt 76 of the opposite side of the first wall 28 and the butt 78 of the leading edge 42 of the second wall 30 abuts the butt 80 of the opposite side of the second wall 30, so that the stairstep adhesive securement of the first side panel 14 to the fifth side panel 22 terminates in a full flush joint between the first side panel 14 and the fifth side panel 22

Alternatively, if desired, the second wall 30 may be slightly shortened, so that when the first side panel 14 is adhesively secured to the fifth side panel 22 in the stairstep configuration, the butt 78 of the leading edge 42 of the second wall 30 does not quite abut the butt 80 of the opposite side of the second wall 30. This alternative embodiment is desirable in situations where it is desired to ensure that the seam on the interior of the container 10 is always flush. Providing a buffer space up to one quarter of an inch between the butt 78 of the leading edge 42 of the second wall 30 and the butt 80 of the opposite side of the second wall 30, allows the butt 74 of the leading edge 48 of the first wall 28 to terminate in a full flush joint against the butt 76 of the opposite side of the first wall 28 even if tolerances are not exacting enough to allow both the joint of the first wall 28 and the joint of the second wall 30 to always be tight at the same time.

As shown in FIGS. 2-5, in the preferred embodiment, once the first side panel 14 is adhesively secured to the fifth side panel 22 in a stairstep configuration as described above, the first side panel 14 and the fifth side panel 22 are terminate in a full flush joint with one another, making both the interior side 122 of the container 10 flush at the seam 126, and the exterior side 124 of the container 10 flush at the seam 126. Although the continuous sheet 12 is preferably provided with five panels 14-22, alternatively two continuous sheets, each having three panels, may be substituted to form the container 10, with the two continuous sheets secured to one another in a similar manner, albeit with two stairstep securements such as that described above (one on each end of each continuous sheet) instead of one.

Once the first side panel 14 is adhesively secured to the fifth side panel 22 in a stairstep configuration, four support brackets 82, 84, 86, and 88 are secured to the container 10. As shown in FIG. 2, support brackets 82, and 84 are secured to the top 90 of the container 10, and support brackets 86 and 88 are secured to the bottom 24 of the container 10. As the support brackets 82, 84, 86, and 88 are of similar construction, description will be limited to one support bracket 82. The support bracket 82 is provided with two side flaps 92 and 94 to secure to the exterior sides of the container 10. The side flaps 92 and 94 are preferably each provided with an ear 96 and 98 to aid in the securement of the support bracket to the container 10. Each side of the support bracket 82 along the side flaps 92 and 94 is provided with two parallel creases 100 and 102, preferably separated by a distance slightly greater than the width of the continuous sheet 12 added to the width of a connector panel 54. A curved opening 104 is die cut out of the support bracket 82 and another crease 106 is provided in the middle of the support bracket 82 to allow the support bracket 82 to fold into the container 10 when the container 10 is folded for shipment or storage. The support bracket 82 may be constructed of any desired material, but is preferably die cut from of a single piece of single wall corrugated cardboard. The support bracket 82 may be constructed of any desired configuration, but is preferably constructed to limit the travel of the two side panels 20 and 22 to which it is connected to no greater than ninety degrees relative to one another. The support bracket 82 is also preferably constructed to provide an opening 116 to allow access to a top cap 108 when the container is being used to store or transport flowable material 110. While the bottom support brackets 86 and 88 may be larger than the top support brackets 82 and 84, since there is typically no top cap on the bottom of the container 10, the support brackets 82, 84, 86, and 88 are typically all identical to reduce the number of parts needed to construct the container 10.

As shown in FIG. 2, support bracket 82 is designed to be adhesively secured to the fourth side panel 20 and the fifth side panel 22, support bracket 84 is designed to be adhesively secured to the second side panel 16 and the third side panel 18, support bracket 86 is designed to be adhesively secured to the third side panel 18 and the fourth side panel 20, and support bracket 88 is designed to be adhesively secured to the fifth side panel 22, the first side panel 14 and the second side panel 16. Offsetting the support brackets in this manner limits the travel of each side panel to no more than ninety degrees.

Once the container 10 has been constructed as described above, the container 10 is expanded as shown in FIG. 2 and a removable bag, such as a flexible liner 112, preferably constructed of polyethylene, such as that well known in the art to hold non-hazardous fluid material, is positioned within the container 10. The nozzle 68 is provided on the liner 112 and extends through a circular cutout 66 provided in the continuous sheet 12. Preferably, the nozzle 68 is provided with a collar 114 that prevents the nozzle 68 and collar 114 from passing through the cutout 66. The liner 112 is also preferably provided with a top cap 108. An opening 116 in the container 10 allows a large fill head (not shown) to enter the container 10 and couple to the top cap 108 to fill the flexible liner 112.

As the flexible liner 112 fills with flowable material 110, such a fruit juice concentrate, tomato paste, or the like, hydrostatic pressure forces the liner 112 against the continuous sheet 12. The support brackets 82, 84, 86, and 88 preferably prevent the side panels 14-22 from extending more than one hundred degrees relative to one another and more preferably more than ninety degrees relative to one another. The stairstep securement of the continuous sheet to itself and the connector panels 54-60 prevent undesirable outward bowing of the side panels 14-22 toward a circular orientation. As shown in FIGS. 1 and 3, once the liner 112 has been filled with flowable material 110, the top cap 108 is closed and a lid 118 is provided over the side panels 14-22. Although the lid 118 may be of any desired construction, in the preferred embodiment, the lid 118 is a piece of single wall cardboard provided with side panels 120 angled downward to frictionally engage the side panels side panels 14-22. If desired, the container 10 may then be wrapped with film or adhesive in a manner such as that known in the art.

When it is desired to store or transport the container 10, the flowable material 110 is removed from the flexible liner 112 through the nozzle 68, and the flexible liner 112 is removed from the container 10. The support brackets 82-88 are then pressed along their center creases 106 to fold the support brackets 82-88 into the interior 128 of the container 12. The side panels 14-22 of the container 12 may then be pushed laterally until the first connector panel 54 is in contact with the second connector panel 56 and the third connector panel 58 is in contact with the fourth connector panel 60 (or alternatively until the first connector panel 54 is in contact with the fourth connector panel 60 and the second connector panel 56 is in contact with the third connector panel 58) and the container 12 is flat enough for storage or transportation.

Figure 6:
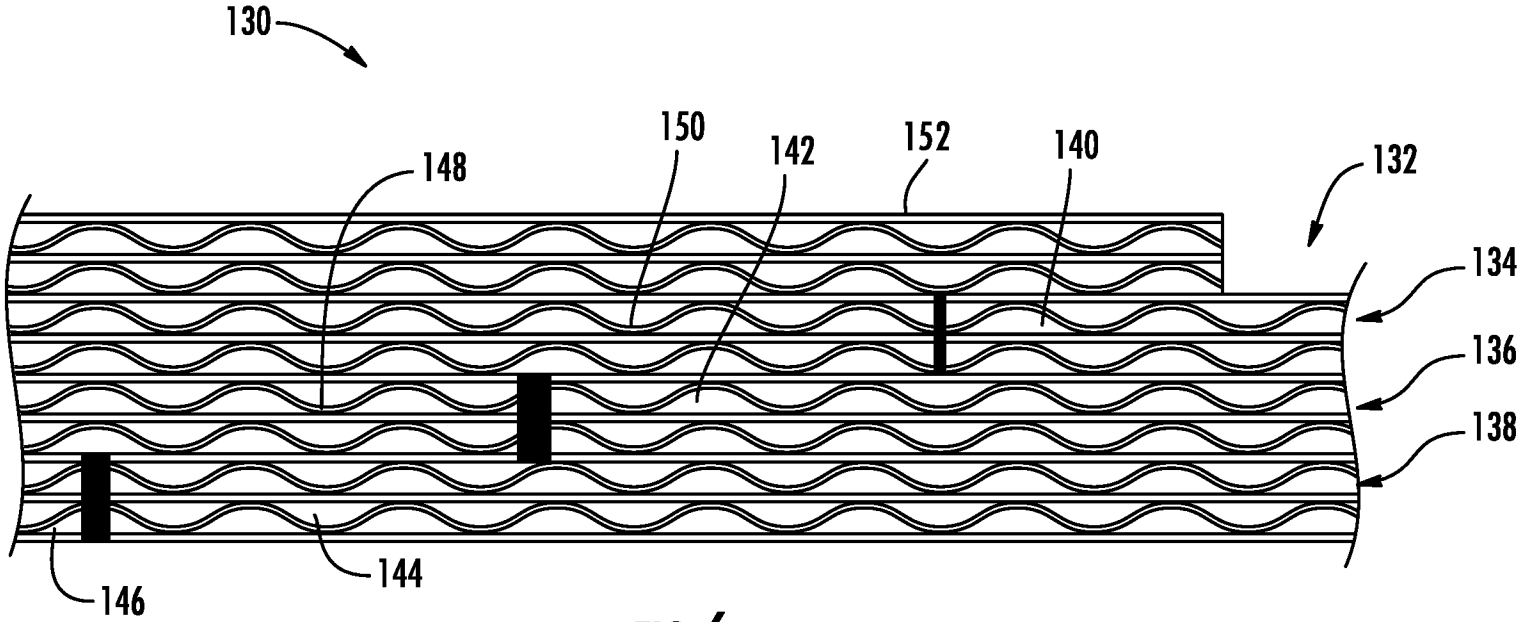
FIG. 6 illustrates a top perspective view of the top of one panel of an alternative embodiment of the present invention.

An alternative embodiment of the present invention is shown generally as 130 in FIG. 6. This embodiment has a continuous sheet 132 constructed of three sheets of double wall cardboard 134, 136, and 138 secured to one another in an offset to provide three first steps 140, 142, and 144 on one end of the continuous sheet 132 and three second steps 146, 148, and 150 on the opposite end of the continuous sheet 132. As shown in FIG. 6, the three first steps 140, 142, and 144 are adhesively secured to three second steps 146, 148, and 150 in a manner such as that described above. Preferably, the steps 140, 142, 144, 146, 148, and 150 each have a length, or "tread," of at least four inches. As explained above, it is desirable to have the three sheets of double wall cardboard 134, 136, and 138 secured to themselves in a stairstep configuration terminating in a full flush joint. Alternatively, the exteriormost facing pairs of steps, (144 and 146) and (142 and 148) may be shortened so as to not quite abut one another to ensure the set of interiormost steps, 140 and 150 always abut tightly with one another to terminate in a full flush joint even with slight variances in manufacturing tolerances in the dimensions of the sheets of double wall cardboard 134, 136, and 138. As shown, a connector panel 152 secured to step 150 is adhesively secured to step 140 in a manner such as that described above.

Figure 7:
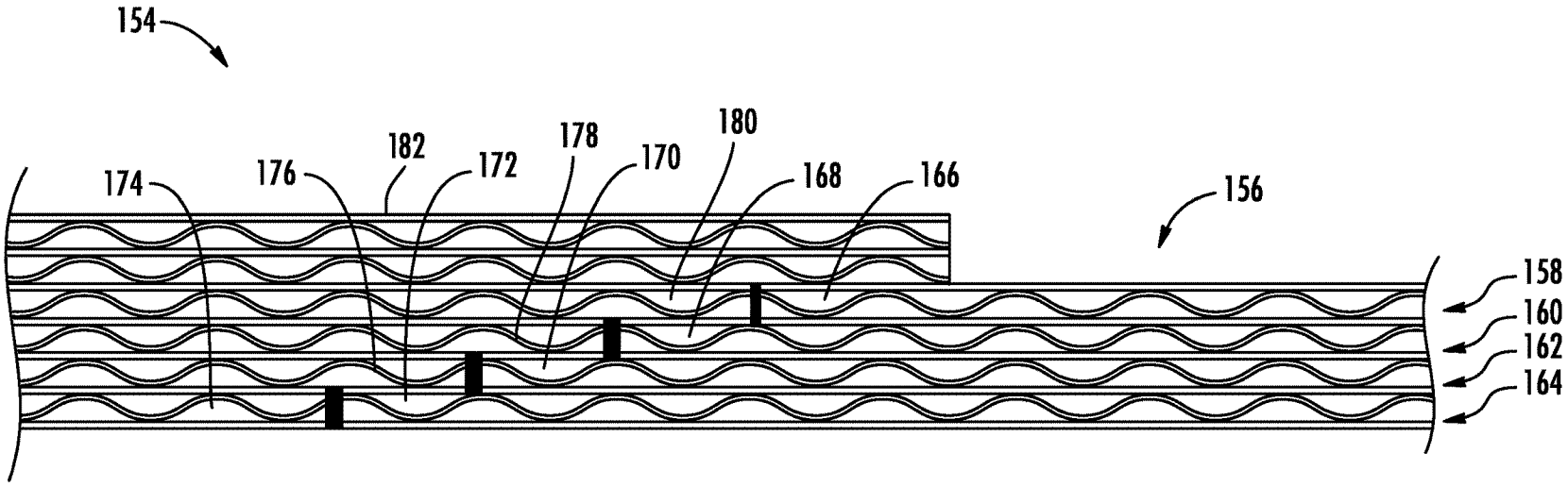
FIG. 7 illustrates a top perspective view of the top of one panel of an alternative embodiment of the present invention.

Another alternative embodiment of the present invention is shown generally as 154 in FIG. 7. This embodiment has a continuous sheet 156 constructed of four sheets of single wall cardboard 158, 160, 162, and 164 secured to one another in an offset to provide four first steps 166, 168, 170, and 172 on one end of the continuous sheet 156 and four second steps 174, 176, 178, and 180 on the opposite end of the continuous sheet 156. As shown in FIG. 7, the four first steps 166, 168, 170, and 172 are adhesively secured to four second steps 174, 176, 178, and 180 in a manner such as that described above. Preferably, the steps 166, 168, 170, 172, 174, 176, 178, and 180 have a length, or "tread," of at least two inches. As shown, a connector panel 182 secured to step 180 is adhesively secured to step 166 in a manner such as that described above.

Although the invention has been described with respect to a preferred embodiment thereof, it is to be understood that it is not to be so limited, since changes and modifications can be made therein which are within the full, intended scope of this invention, as defined by the appended claims.

What is claimed is:

1. A collapsible container comprising:

(a) a first side panel, comprising;
  (i) a first corrugated wall having an interior side and an exterior side;
  (ii) a second corrugated wall having an interior side and an exterior side;
  (iii) wherein the interior side of the first corrugated wall is secured to the exterior side of the second corrugated wall;
  (iv) wherein the first corrugated wall is larger than the second corrugated wall;
(b) a second side panel coupled to the first side panel;
(c) a first bracket coupling the first side panel to the second side panel;
(d) a second bracket coupling the first side panel to the second side panel;
(e) a third side panel coupled to the second side panel;
(f) a fourth side panel coupled to the third side panel;
(g) a fifth side panel coupled to the fourth side panel, the fifth side panel, comprising;
  (i) a third corrugated wall having an interior side and an exterior side;
  (ii) a fourth corrugated wall having an interior side and an exterior side;
  (iii) wherein the interior side of the third corrugated wall is secured to the exterior side of the fourth corrugated wall;
  (iv) wherein the fourth corrugated wall is larger than the third corrugated wall;
(h) a third bracket coupling the fourth side panel to the fifth side panel;
(i) a fourth bracket coupling the fourth side panel to the fifth side panel;
(j) wherein at least a portion of the interior side of the first corrugated wall is secured to at least a portion of the exterior side of the fourth corrugated wall;
(k) a corrugated connector panel having an having an interior side and an exterior side;
(l) wherein at least a first portion of the interior side of the corrugated connector panel is secured to at least a portion of the interior side of the second corrugated wall;
(m) wherein at least a second portion of the interior side of the corrugated connector panel is secured to at least a portion of the interior side of the fourth corrugated wall; and
(n) wherein the first side panel, the second side panel, the third side panel, the fourth side panel, and the fifth side panel define an interior of the collapsible container.

2. A collapsible container comprising:

(a) a first, side panel, comprising;
  (i) a first corrugated wall having an interior side and an exterior side;
  (ii) a second corrugated wall having an interior side and an exterior side;
  (iii) wherein the interior side of the first corrugated wall is secured to the exterior side of the second corrugated wall;
  (iv) wherein the first corrugated wall is larger than the second corrugated wall;
(b) a second side panel coupled to the first side panel;
(c) a thud side panel coupled to the second side panel;
(d) a fourth side panel coupled to the third side panel;
(e) a fifth side panel coupled to the fourth side panel, the fifth side panel, comprising;

(i) a third corrugated wall having an interior side and an exterior side;

(ii) a fourth corrugated wall having an interior side and an exterior side;

(iii) wherein the interior side of the third corrugated wall is secured to the exterior side of the fourth corrugated wall;

(iv) wherein the fourth corrugated wall is larger than the third corrugated wall;

(f) wherein at least a portion of the interior side of the first corrugated wall is secured to at least a portion of the exterior side of the fourth corrugated wall;

(g) a corrugated connector panel having an having an interior side and an exterior side;

(h) wherein at least a first portion of the interior side of the corrugated connector panel is secured to at least a portion of the interior side of the second corrugated wall;

(i) wherein at least a second portion of the interior side of the corrugated connector panel is secured to at least a portion of the interior side of the fourth corrugated wall;

(j) wherein the first side panel, the second side panel, the third side panel, the fourth side panel, and the fifth side panel define an interior of the collapsible container;

(k) wherein the first corrugated wall and second corrugated wall are secured to one another in a stairstep configuration; and (l) wherein the third corrugated wall and fourth corrugated wall are secured to one another in a stairstep configuration terminating in a flush joint.

3. A collapsible container comprising:

(a) a first side panel, comprising;

(i) a first corrugated wall having an interior side and an exterior side;

(ii) a second corrugated wall having an interior side and an exterior side;

(iii) wherein the interior side of the first corrugated wall is secured to the exterior side of the second corrugated wall;

(iv) wherein the first corrugated wall is larger than the second corrugated wall;

(b) a second side panel coupled to the first side panel;

(c) a third side panel coupled to the second side panel;

(d) a fourth side panel coupled to the third side panel;

(e) a fifth side panel coupled to the fourth side panel, the fifth side panel, comprising;

(i) a third corrugated wall having an interior side and an exterior side;

(ii) a fourth corrugated wall having an interior side and an exterior side;

(iii) wherein the interior side of the third corrugated wall is secured to the exterior side of the fourth corrugated wall;

(iv) wherein the fourth corrugated wall is larger than the third corrugated wall;

(f) wherein at least a portion of the interior side of the first corrugated wall is secured to at least a portion of the exterior side of the fourth corrugated wall;

(g) a corrugated connector panel having an having an interior side and an exterior side;

(h) wherein at least a first portion of the interior side of the corrugated connector panel is secured to at least a portion of the interior side of the second corrugated wall;

(i) wherein at least a second portion of the interior side of the corrugated connector panel is secured to at least a portion of the interior side of the fourth corrugated wall;

(j) wherein the first side panel, the second side panel, the third side panel the fourth side panel, and the fifth side panel define an interior of the collapsible container;

(k) wherein the first side panel, the second side panel, the third side panel, the fourth side panel, and the fifth side panel are integrally formed as a continuous sheet; and (l) wherein the first side panel is secured to the fifth side panel in a flush joint.

4. A collapsible container comprising:

(a) a first side panel, comprising;

(i) a first corrugated wall having an interior side and an exterior side;

(ii) a second corrugated wall having an interior side and an exterior side;

(iii) wherein the interior side of the first corrugated wall is secured to the exterior side of the second corrugated wall;

(iv) wherein the first corrugated wall is larger than the second corrugated wall;

(b) a second side panel coupled to the first side panel;

(c) a third side panel coupled to the second side panel;

(d) a fourth side panel coupled to the third side panel;

(e) a fifth side panel coupled to the fourth side panel, the fifth side panel, comprising;

(i) a third corrugated wall having an interior side and an exterior side;

(ii) a fourth corrugated wall having an interior side and an exterior side;

(iii) wherein the interior side of the third corrugated wall is secured to the exterior side of the fourth corrugated wall;

(iv) wherein the fourth corrugated wall is larger than the third corrugated wall;

(f) wherein at least a portion of the interior side of the first corrugated wall is secured to at least a portion of the exterior side of the fourth corrugated wall;

(g) a corrugated connector panel having an having an interior side and an exterior side;

(h) wherein at least a first portion of the interior side of the corrugated connector panel is secured to at least a portion of the interior side of the second corrugated wall;

(i) wherein at least a second portion of the interior side of the corrugated connector panel is secured to at least a portion of the interior side of the fourth corrugated wall;

(j) wherein the first side panel, the second side panel, the third side panel, the fourth side panel, and the fifth side panel define an interior of the collapsible container;

(k) wherein the second side panel further comprises a fifth corrugated wall and a sixth corrugated wall;

(l) wherein the third side panel further comprises a seventh corrugated wall and an eighth corrugated wall;

(m) wherein the fourth side panel further comprises a ninth corrugated wall and a tenth corrugated wall;

(n) wherein the first corrugated wall, the third corrugated wall, the fifth corrugated wall, the seventh corrugated wall, and the ninth corrugated wall are integrally formed as a first single continuous sheet; and (o) wherein the second corrugated wall, the fourth corrugated wall, the sixth corrugated wall, the eighth corrugated wall, and the ninth tenth corrugated wall are integrally formed as a second single continuous sheet.

5. A collapsible container comprising:
(a) a first side panel, comprising;
(i) a first corrugated wall having an interior side and an exterior side;
(ii) a second corrugated wall having an interior side and an exterior side;
(iii) wherein the interior side of the first corrugated wall is secured to the exterior side of the second corrugated wall;
(iv) wherein the first corrugated wall is larger than the second corrugated wall;
(b) a second side panel coupled to the first side panel;
(c) a third side panel coupled to the second side panel;
(d) a fourth side panel coupled to the third side panel;
(e) a fifth side panel coupled to the fourth side panel the fifth side panel, comprising;
(i) a third corrugated wall having an interior side and an exterior side;
(ii) a fourth corrugated wall having an interior side and an exterior side;
(iii) wherein the interior side of the third corrugated wall is secured to the exterior side of the fourth corrugated wall;
(iv) wherein the fourth corrugated wall is larger than the third corrugated wall;
(f) wherein at least a portion of the interior side of the first corrugated wall is secured to at least a portion of the exterior side of the fourth corrugated wall;
(g) a corrugated connector panel having an having an interior side and an exterior side;
(h) wherein at least a first portion of the interior side of the corrugated connector panel is secured to at least a portion of the interior side of the second corrugated wall;
(f) wherein at least a second portion of the interior side of the corrugated connector panel is secured to at least a portion of the interior side of the fourth corrugated wall;
(j) wherein the first side panel, the second side panel, the third side panel, the fourth side panel, and the fifth side panel define an interior of the collapsible container;
(k) wherein the second side panel further comprises a fifth corrugated wall and a sixth corrugated wall;
(l) wherein the third side panel further comprises a seventh corrugated wall and an eighth corrugated wall;
(m) wherein the fourth side panel further comprises a ninth corrugated wall and a tenth corrugated wall;
(n) wherein the first corrugated wall, the third corrugated wall, the fifth corrugated wall, the seventh corrugated wall, and the ninth corrugated wall form are integrally formed as a first single continuous sheet of single wall cardboard; and
(o) wherein the second corrugated wall, the fourth corrugated wall, the sixth corrugated wall, the eighth corrugated wall, and the tenth corrugated wall are integrally formed as a second single continuous sheet of single wall cardboard.

6. A collapsible container comprising:
(a) a first side panel, comprising;
(i) a first corrugated wall having an interior side and an exterior side;
(ii) a second corrugated wall having an interior side and an exterior side;
(iii) wherein the interior side of the first corrugated wall is secured to the exterior side of the second corrugated wall;
(iv) wherein the first corrugated walls is larger than the second corrugated wall;
(b) a second side panel coupled to the first side panel;
(c) a third side panel coupled to the second side panel;
(d) a fourth side panel coupled to the third side panel;
(e) a fifth side panel coupled to the fourth side panel, the fifth side panel, comprising;
(i) a third corrugated wall having an interior side and an exterior side;
(ii) a fourth corrugated wall having an interior side and an exterior side;
(iii) wherein the interior, side of the third corrugated wall is secured to the exterior side of the fourth corrugated wall;
(iv) wherein the fourth corrugated wall is larger than the third corrugated wall;
(f) wherein at least a portion of the interior side of the first corrugated wall is secured to at least a portion of the exterior side of the fourth corrugated wall;
(g) a corrugated connector panel having an having an interior side and an exterior side;
(h) wherein at least a first portion of the interior side of the corrugated connector panel is secured to at least a portion of the interior side of the second corrugated wall;
(i) wherein at least a second portion of the interior side of the corrugated connector panel is secured to at least a portion of the interior side of the fourth corrugated wall;
(j) wherein the first side panel, the second side panel, the third side panel, the fourth side panel, and the fifth side panel define an interior of the collapsible container;
(k) wherein the second side panel further comprises a fifth corrugated wall and a sixth corrugated wall;
(l) wherein the third side panel further comprises a seventh corrugated wall and an eighth corrugated wall;
(m) wherein the fourth side panel further comprises a ninth corrugated wall and a tenth corrugated wall;
(n) wherein the first corrugated wall, the third corrugated wall, the fifth corrugated wall, the seventh corrugated wall, and the ninth corrugated wall are integrally formed as a first single continuous sheet of double wall cardboard; and
(o) wherein the second corrugated wall, the fourth corrugated wall, the sixth corrugated wall, the eighth corrugated wall, and the tenth corrugated wall are integrally formed as a second single continuous sheet of double wall cardboard.

7. A collapsible container of claim 1, comprising:
(a) a first side panel, comprising;
(i) a first corrugated wall having an interior side and an exterior side;
(ii) a second corrugated wall having an interior side and an exterior side;
(iii) wherein the interior side of the first corrugated wall is secured to the exterior side of the second corrugated wall;
(iv) wherein the first corrugated wall is larger than the second corrugated wall;
(b) a second side panel coupled to the first side panel;
(c) a third side panel coupled to the second side panel;
(d) a fourth side panel coupled to the third side panel;
(e) a fifth side panel coupled to the fourth side panel, the fifth side panel, comprising;
(i) a third corrugated wall having an interior side and an exterior side;

(ii) a fourth corrugated wall having an interior side and an exterior side;

(iii) wherein the interior side of the third corrugated wall is secured to the exterior side of the fourth corrugated wall;

(iv) wherein the fourth corrugated wall is larger than the third corrugated wall;

(f) wherein at least a portion of the interior side of the first corrugated wall is secured to at least a portion of the exterior side of the fourth corrugated wall;

(g) a corrugated connector panel having an having an interior side and an exterior side;

(h) wherein at least a first portion of the interior side of the corrugated connector panel is secured to at least a portion of the interior side of the second corrugated wall;

(i) wherein at least a second portion of the interior side of the corrugated connector panel is secured to at least a portion of the interior side of the fourth corrugated wall;

(j) wherein the first side panel, the second side panel, the third side panel, the fourth side panel and the fifth side panel define an interior of the collapsible container;

(k) wherein the second side panel further comprises a fifth corrugated wall and a sixth corrugated wall;

(l) wherein the third side panel further comprises a seventh corrugated wall and an eighth corrugated wall;

(m) wherein the fourth side panel further comprises a ninth corrugated wall and a tenth corrugated wall;

(n) wherein the first corrugated wall, the third corrugated wall, the fifth corrugated wall, the seventh corrugated wall, and the ninth corrugated wall are integrally formed as a first single continuous sheet of triple wall cardboard; and (o) wherein the second corrugated wall, the fourth corrugated wall, the sixth corrugated wall, the eighth corrugated wall, and the tenth corrugated wall are integrally formed as a second single continuous sheet of triple wall cardboard.

8. A collapsible container comprising:

(a) a first side panel, comprising:

(i) a first corrugated wall having an interior side and an exterior side;

(ii) a second corrugated wall having an interior side and an exterior side;

(iii) wherein the interior side of the first corrugated wall is secured to the exterior side of the second corrugated wall;

(iv) wherein the first corrugated wall is larger than the second corrugated wait, (b) a second side panel coupled to the first side panel;

(c) a third side panel coupled to the second side panel;

(d) a fourth side panel coupled to the third side panel;

(e) a fifth side panel coupled to the fourth side panel, the fifth side panel, comprising;

(i) a third corrugated wall having an interior side and an exterior side;

(ii) a fourth corrugated wall having an interior side and an exterior side;

(iii) wherein the interior side of the third corrugated wall is secured to the exterior side of the fourth corrugated wall;

(iv) wherein the fourth corrugated wall is larger than the third corrugated wall;

(f) wherein at least a portion of the interior side of the first corrugated wall is secured to at least a portion of the exterior side of the fourth corrugated wall;

(g) a corrugated connector panel having an having an interior side and an exterior side;

(h) wherein at least a first portion of the interior side of the corrugated connector panel is secured to at least a portion of the interior side of the second corrugated wall;

(i) wherein at least a second portion of the interior side of the corrugated connector panel is secured to at least a portion of the interior side of the fourth corrugated wall;

(j) wherein the first side panel, the second side panel, the third side panel, the fourth side panel, and the fifth side panel define an interior of the collapsible container;

(k) wherein the first corrugated wall is provided with a first leading edge;

(l) wherein the second corrugated wall is provided with a second leading edge;

(m) wherein the first leading edge extends at least two inches beyond the second leading edge;

(n) wherein the third corrugated wall is provided with a third leading edge;

(o) wherein the fourth corrugated wall is provided with a fourth leading edge; and (p) wherein the fourth leading edge extends at least two inches beyond the third leading edge.

9. A collapsible container comprising:

(a) a first side panel, comprising;

(i) a first corrugated wall having an interior side and an exterior side;

(ii) a second corrugated wall having, an interior side and an exterior side;

(iii) wherein the interior side of the first corrugated wall is secured to the exterior side of the second corrugated wall;

(iv) wherein the first corrugated wall is larger than the second corrugated wall;

(b) a second side panel coupled to the first side panel;

(c) a third side panel coupled to the second side panel;

(d) a fourth side panel coupled to the third side panel;

(e) a fifth side panel coupled to the fourth side panel, the fifth side panel, comprising;

(i) a third corrugated wall having an interior side and an exterior side;

(ii) a fourth corrugated wall having an interior side and an exterior side;

(iii) wherein the interior side of the third corrugated wall is secured to the exterior side of the fourth corrugated wall;

(iv) wherein the fourth corrugated wall is larger than the third corrugated wall;

(f) wherein at least a portion of the interior side of the first corrugated wall is secured to at least a portion of the exterior side of the fourth corrugated wall;

(g) a corrugated connector panel having an having an interior side and an exterior side;

(h) wherein at least a first portion of the interior side of the corrugated connector panel is secured to at least a portion of the interior side of the second corrugated wall;

(i) wherein at least a second portion of the interior side of the corrugated connector panel is secured to at least a portion of the interior side of the fourth corrugated wall;

(j) wherein the first side panel, the second side panel, the third side panel, the fourth side panel, and the fifth side panel define an interior of the collapsible container;

(k) wherein the first corrugated wall is provided with a first leading edge;
(l) wherein the second corrugated wall is provided with a second leading edge;
(m) wherein the first leading edge extends at least four inches beyond the second leading edge;
(n) wherein the third corrugated wall is provided with a third leading edge;
(o) wherein the fourth corrugated wall is provided with a fourth leading edge; and
(p) wherein the fourth leading edge extends at least four inches beyond the third leading edge.

10. A collapsible container comprising:
(a) a first side panel, comprising;
(i) a first corrugated wall having a first leading edge, wherein the first leading edge is provided with an interior side and an exterior side;
(ii) a second corrugated wall having a second leading edge, wherein the second leading edge is provided with an interior side and an exterior side;
(iii) a third corrugated wall having a third leading edge, wherein the third leading edge is provided with an interior side and an, exterior side;
(iv) wherein the first corrugated wall is coupled to the second corrugated wall;
(v) wherein the second corrugated wall is coupled to the third corrugated wall;
(b) a second side panel coupled to the first side panel, the second side panel comprising;
(i) a fourth corrugated wall having a fourth leading edge, wherein the fourth leading edge is provided with an interior side and an exterior side;
(ii) a fifth corrugated wall having a fifth leading edge, wherein the fifth leading edge is provided with an interior side and an exterior side;
(iii) a sixth corrugated wall having a sixth leading edge, wherein the sixth leading edge is provided with an interior side and an exterior side;
(iv) wherein the fourth corrugated wall is coupled to the fifth corrugated wall;
(v) wherein the fifth corrugated wall is coupled to the sixth corrugated wall;
(c) wherein the first leading edge extends at least two inches beyond the second leading edge;
(d) wherein the second leading edge extends at least two inches beyond the third leading edge;
(e) wherein the sixth leading edge extends at least two inches beyond the fifth leading edge;
(f) wherein the fifth leading edge extends at least two inches beyond the sixth leading edge;
(g) wherein the interior side of the first leading edge is secured to the exterior side of the fifth leading edge;
(h) wherein the interior side of the second leading edge is secured to the exterior side of the sixth leading edge; and
(l) wherein the first side panel and the second side panel define an interior of the collapsible container.

11. The collapsible container of claim 10, wherein the first side panel and the second side panel are secured to one another in a stairstep configuration.

12. The collapsible container of claim 10, wherein the first side panel and the second side panel are integrally formed as a continuous sheet.

13. The collapsible container of claim 10, wherein the first corrugated wall and the fourth corrugated wall are integrally formed as a first single continuous sheet, wherein the second corrugated wall and the fifth corrugated wall are integrally formed as a second single continuous sheet, and wherein the third corrugated wall and the sixth corrugated wall are integrally formed as a third single continuous sheet.

14. The collapsible container of claim 10, wherein the first corrugated wall and the fourth corrugated wall are integrally formed as a first single continuous sheet of single wall cardboard, wherein the second corrugated wall and the fifth corrugated wall are integrally formed as a second single continuous sheet of single wall cardboard, and wherein the third corrugated wall and the sixth corrugated wall are integrally formed as a third single continuous sheet of single wall cardboard.

15. The collapsible container of claim 10, further comprising a flexible bag provided within the interior of the collapsible container.

16. The collapsible container of claim 10, further comprising a corrugated connector panel, wherein the corrugated connector panel is secured to the interior side of the third leading edge and to the interior side of the sixth leading edge.

17. A collapsible container comprising;
(a) a first side panel, comprising;
(i) a first corrugated wall having a first leading edge, wherein the first leading edge is provided with an interior side and an exterior side;
(ii) a second corrugated wall having a second leading edge, wherein the second leading edge is provided with an interior side and an exterior side;
(iii) wherein the first corrugated wall is coupled to the second corrugated wall;
(b) a second side panel coupled to the first side panel, the second side panel comprising;
(i) a third corrugated wall having a third leading edge, wherein the third leading edge is provided with an interior side and an exterior side;
(ii) a fourth corrugated wall having a fourth leading edge, wherein the fourth leading edge is provided with an interior side and an exterior side;
(iii) wherein the third corrugated wall is coupled to the fourth corrugated wall;
(c) wherein the first leading edge extends at least two inches beyond the second leading edge;
(d) wherein the second leading edge extends at least two inches beyond the third leading edge;
(e) wherein the fourth leading edge extends at least two inches beyond the third leading edge;
(f) wherein the interior side of the first leading edge is secured to the exterior side of the fourth leading edge;
(g) wherein the first corrugated wall and the third corrugated wall are integrally formed as a first single continuous sheet;
(h) wherein the second corrugated wall and the fourth corrugated wall are integrally formed as a second single continuous sheet;
(i) a corrugated connector panel having an having an interior side and an exterior side;
(j) wherein at least a first portion of the interior side of the corrugated connector panel is secured to at least a portion of the interior side of the second leading edge;
(k) wherein at least a second portion of the interior side of the corrugated connector panel is secured to at least a portion of the interior side of the fourth corrugated wall; and
(l) wherein the first side panel and the second side panel define an interior of the collapsible container.

* * * * *